US012392540B2

(12) United States Patent
Ye et al.

(10) Patent No.: US 12,392,540 B2
(45) Date of Patent: Aug. 19, 2025

(54) REFRIGERATOR

(71) Applicants: Guangdong Midea White Home Appliance Technology Innovation Center Co., Ltd., Foshan (CN); Midea Group Co., Ltd., Foshan (CN)

(72) Inventors: Mingkun Ye, Foshan (CN); Shenqi Yang, Foshan (CN); Xianghua Ren, Foshan (CN); Xin Zhou, Foshan (CN)

(73) Assignees: Guangdong Midea White Home Appliance Technology Innovation Center Co., Ltd., Foshan (CN); Midea Group Co., Ltd., Foshan (CN)

( * ) Notice: Subject to any disclaimer, the term of this patent is extended or adjusted under 35 U.S.C. 154(b) by 433 days.

(21) Appl. No.: 17/843,905

(22) Filed: Jun. 17, 2022

(65) Prior Publication Data

US 2022/0357090 A1 Nov. 10, 2022

Related U.S. Application Data

(63) Continuation of application No. PCT/CN2020/134690, filed on Dec. 8, 2020.

(30) Foreign Application Priority Data

Dec. 23, 2019 (CN) ..... 201911339640.4

(51) Int. Cl.
*F25D 17/04* (2006.01)
*F25D 17/06* (2006.01)
*F25D 29/00* (2006.01)

(52) U.S. Cl.
CPC ..... *F25D 17/042* (2013.01); *F25D 17/062* (2013.01); *F25D 29/005* (2013.01)

(58) Field of Classification Search
CPC .... F25D 17/042; F25D 17/062; F25D 29/005; F25D 25/025; F25D 11/00; F25D 23/00; F25D 2317/0415
See application file for complete search history.

(56) References Cited

U.S. PATENT DOCUMENTS 5,451,248 A * 9/1995 Sadkowski ..... A23B 7/148 96/132
7,497,089 B2 * 3/2009 Kakiuchi ..... B01J 20/0292 62/476

(Continued)

FOREIGN PATENT DOCUMENTS

CN 2312064 Y 3/1999
CN 102679616 A * 9/2012

(Continued)

OTHER PUBLICATIONS

Midea Group Co., Ltd., ISRWO, PCT/CN2020/134690, Feb. 25, 2021, 18 pgs.

(Continued)

*Primary Examiner* — Dung H Bui
(74) *Attorney, Agent, or Firm* — Morgan, Lewis & Bockius LLP

(57) ABSTRACT

A refrigerator is provided. The refrigerator includes a first fresh-preservation chamber, one or more adsorption towers, a valve, and an air pump. An air inlet of the air pump is in communication with the first fresh-preservation chamber, an air outlet of the air pump is in communication with an air inlet of each of the one or more adsorption towers through an air inlet channel of the valve, and the air inlet of each of the one or more adsorption towers is in communication with the first fresh-preservation chamber through an air outlet channel of the valve.

15 Claims, 7 Drawing Sheets

(56) References Cited

U.S. PATENT DOCUMENTS

| | | | | |
|---|---|---|---|---|
| 2009/0192205 | A1* | 7/2009 | Augustijns | A61K 31/41 514/359 |
| 2015/0121919 | A1* | 5/2015 | Lee | F25D 29/00 62/157 |
| 2017/0205137 | A1* | 7/2017 | Hitzelberger | B01D 53/261 |
| 2017/0251682 | A1* | 9/2017 | Kamei | F25D 11/00 |
| 2019/0145691 | A1* | 5/2019 | Liu | B01D 53/053 96/143 |
| 2019/0166861 | A1* | 6/2019 | Felicetti | A23B 7/152 |
| 2023/0103443 | A1* | 4/2023 | Ren | F25D 17/042 62/78 |

FOREIGN PATENT DOCUMENTS

| | | | |
|---|---|---|---|
| CN | 105923613 | A | 9/2016 |
| CN | 105953495 | A | 9/2016 |
| CN | 106016950 | A | 10/2016 |
| CN | 106052254 | A | 10/2016 |
| CN | 106052291 | A | 10/2016 |
| CN | 106091519 | A | 11/2016 |
| CN | 106091532 | A | 11/2016 |
| CN | 106115637 | A | 11/2016 |
| CN | 106247731 | A | 12/2016 |
| CN | 106288637 | A | 1/2017 |
| CN | 206131588 | U | 4/2017 |
| CN | 106642909 | A | 5/2017 |
| CN | 106642910 | A | 5/2017 |
| CN | 106642968 | A | 5/2017 |
| CN | 206291580 | U | 6/2017 |
| CN | 206352919 | U | 7/2017 |
| CN | 107076494 | A | 8/2017 |
| CN | 107076497 | A | 8/2017 |
| CN | 107250693 | A | 10/2017 |
| CN | 105923613 | B | 2/2018 |
| CN | 106115637 | B | 4/2018 |
| CN | 107923692 | A | 4/2018 |
| CN | 105953495 | B | 7/2018 |
| CN | 106016950 | B | 8/2018 |
| CN | 207849867 | U | 9/2018 |
| CN | 106052254 | B | 10/2018 |
| CN | 106052291 | B | 1/2019 |
| CN | 106091532 | B | 1/2019 |
| CN | 109464877 | A | 3/2019 |
| CN | 109613859 | A | 4/2019 |
| CN | 211876472 | U | 11/2020 |
| JP | S 5914749 | A | 1/1984 |
| JP | H 0282083 | A | 3/1990 |
| JP | H 02203185 | A | 8/1990 |
| JP | H 1121107 | A | 1/1999 |
| JP | 2018096596 | A | 6/2018 |
| JP | 2019515235 | A | 6/2019 |
| KR | 20160008778 | A | 1/2016 |
| WO | WO 2017202089 | A1 | 11/2017 |
| WO | WO 2017202090 | A1 | 11/2017 |
| WO | WO 2017206556 | A1 | 12/2017 |
| WO | WO 2017206557 | A1 | 12/2017 |
| WO | WO 2017219694 | A1 | 12/2017 |

OTHER PUBLICATIONS

Midea Group Co., Ltd., Extended European Search Report and Supplementary Search Report, EP20904758.8, Nov. 23, 2022, 11 pgs.

Midea Group Co., Ltd., IPRP, PCT/CN2020/134690, Jun. 13, 2023, 6 pgs.

Midea Group Co., Ltd., Japanese Office Action, JP Patent Application No. 2022-537804, Jul. 4, 2023, 12 pgs.

Midea Group Co., Ltd., Japanese Office Action, JP Patent Application No. 2022-537804, Jan. 9, 2024, 8 pgs.

Midea Group Co., Ltd., Chinese Office Action, CN Patent Application No. 201911339640.4, May 28, 2024, 25 pgs.

Midea Group Co., Ltd., Japanese Office Action, JP Patent Application No. 2022-537804, Jun. 21, 2024, 5 pgs.

Midea Group Co., Ltd., Chinese Office Action, CN Patent Application No. 201911339640.4, Dec. 20, 2024, 20 pgs.

China Commercial Press, "Fruit Storage Technology", Fruit Storage Writing Group, trial textbooks for secondary supply and marketing schools, Apr. 1990, 10 pgs.

* cited by examiner

REFRIGERATOR

CROSS REFERENCE

The application is a continuation of PCT International Patent Application No. PCT/CN2020/134690, filed on Dec. 8, 2020, entitled "Refrigerator," which claims priority to Chinese Patent Application No. 201911339640.4, filed on Dec. 23, 2019, the contents of which are herein incorporated by reference in their entireties.

TECHNICAL FIELD

The present disclosure relates to the field of home appliances, and in particular to a refrigerator.

BACKGROUND

During a long-distance transportation and storage, in order to keep fruits and vegetables fresh, a technology of reducing oxygen and filling with nitrogen for a fresh preservation has been widely used at home and abroad. However, in the field of home appliances, the technology has not been effectively used due to technical limitations, for example, an oxygen content is not significantly reduced.

SUMMARY

In some embodiments, a refrigerator in which an oxygen content is significantly reduced in a first fresh-preservation chamber of the refrigerator is provided.

According to an aspect of the present disclosure, a refrigerator is provided. The refrigerator includes a first fresh-preservation chamber, one or more adsorption towers, a valve, and an air pump. An air inlet of the air pump is in communication with the first fresh-preservation chamber, an air outlet of the air pump is in communication with an air inlet of each of the one or more adsorption towers through an air inlet channel of the valve, and the air inlet of each of the one or more adsorption towers is in communication with the first fresh-preservation chamber through an air outlet channel of the valve. In response to the air inlet channel of the valve being opened, the air pump is configured to pressurize air in the first fresh-preservation chamber, and transmit the air to each of the one or more adsorption towers, each of the one or more adsorption towers is configured to filter out oxygen in the air, the oxygen is discharged from an air outlet of each of the one or more adsorption towers, and residual gas is adsorbed by each of the one or more adsorption towers. In response to the air inlet channel of the valve being closed, the air pump is configured to stop pressurizing the air and transmitting the air to each of the one or more adsorption towers, the residual gas is released by each of the one or more adsorption towers, and discharged to the first fresh-preservation chamber through the air inlet of each of the one or more adsorption towers and the air outlet channel of the valve.

In some embodiments, the one or more adsorption towers include at least two adsorption towers, and the at least two adsorption towers include a first adsorption tower and a second adsorption tower. The valve defines a first air inlet channel and a first air outlet channel corresponding to each first adsorption tower, and defines a second air inlet channel and a second air outlet channel corresponding to each second adsorption tower. The valve is alternately switched between a state that the first air inlet channel is opened while the second air inlet channel of the valve is closed and a state that the first air inlet channel is closed while the second air inlet channel is opened.

In some embodiments, the one or more adsorption towers include two adsorption towers, and the valve is a two-position five-way solenoid valve.

In some embodiments, the at least two adsorption towers are arranged side by side, and all of the air inlets of the adsorption towers are arranged to face a same direction.

In some embodiments, each of the one or more adsorption towers is arranged with a zeolite molecular sieve particle, and a particle size of the zeolite molecular sieve particle is in a range from 0.4 mm to 0.8 mm. A pressure pressurized by the air pump on the air is in a range from 0.12 MPa to 0.2 MPa.

In some embodiments, a ratio of a transmission flow of the air pump per second to a volume of each of the one or more adsorption towers is in a range from 1.2 to 2.2.

In some embodiments, a shape of each of the one or more adsorption towers is substantially cylindrical, a diameter of each of the one or more adsorption towers is in a range from 20 mm to 30 mm, and a height of each of the one or more adsorption towers is in a range from 150 mm to 300 mm. a transmission flow of the air pump is in a range from 5 L/min to 15 L/min.

In some embodiments, the refrigerator further includes a second fresh-preservation chamber. The air outlet of each of the one or more adsorption towers is in communication with the second fresh-preservation chamber.

In some embodiments, the first fresh-preservation chamber is arranged with a first sensor, and the first sensor is configured to detect the oxygen content of the first fresh-preservation chamber and is connected to the air pump.

In some embodiments, the first fresh-preservation chamber is arranged with a second sensor, and the second sensor is configured to detect whether the first fresh-preservation chamber is opened and is connected to the air pump.

In some embodiments of the present disclosure, an adsorption state or desorption state of the adsorption tower may be controlled by an operation of the valve and the air pump. When the adsorption tower is in the adsorption state, the adsorption tower may be configured to filter out the oxygen in the air, the oxygen may be discharged from the air outlet of the adsorption tower, and the residual gas may be adsorbed by the adsorption tower. When the adsorption tower is in the desorption state, the residual gas may be released by the adsorption tower, and discharged into the first fresh-preservation chamber through the air inlet of the adsorption tower and the air outlet channel of the valve. The air in the first fresh-preservation chamber may be extracted and filtered out, and the residual gas from which the oxygen is removed may be returned, thereby reducing the oxygen content of the first fresh-preservation chamber. In other words, the oxygen content of the first fresh-preservation chamber may be effectively reduced by the air pump, the valve, and the adsorption tower, such that the fresh preservation is achieved by means of controlling the oxygen, thereby improving a fresh-preservation effect. Further, a total air content of the first fresh-preservation chamber may also be reduced, such that the air in the first fresh-preservation chamber may be in a negative pressure state, thereby achieving the fresh preservation by means of the negative pressure. Thus, double fresh-preservation effect may be achieved by means of controlling the oxygen and the negative pressure.

BRIEF DESCRIPTION OF THE DRAWINGS

In order to more clearly describe the technical solutions in the embodiments of the present disclosure or the related art, the drawings that need to be used in the description of the embodiments or the related art will be briefly described in the following. Apparently, the drawings in the following description are only some embodiments of the present disclosure. For those skilled in the art, other drawings can be obtained based on these drawings without creative work.

DETAILED DESCRIPTION

The technical solutions in the embodiments of the present disclosure will be clearly and completely described below in conjunction with the accompanying drawings in the embodiments of the present disclosure. It is clear that the embodiments described are only a part of the embodiments of the present disclosure, and not all of them. Based on the embodiments in the present disclosure, other embodiments obtained by those skilled in the art without creative work fall within the scope of the present disclosure.

Figure 1:
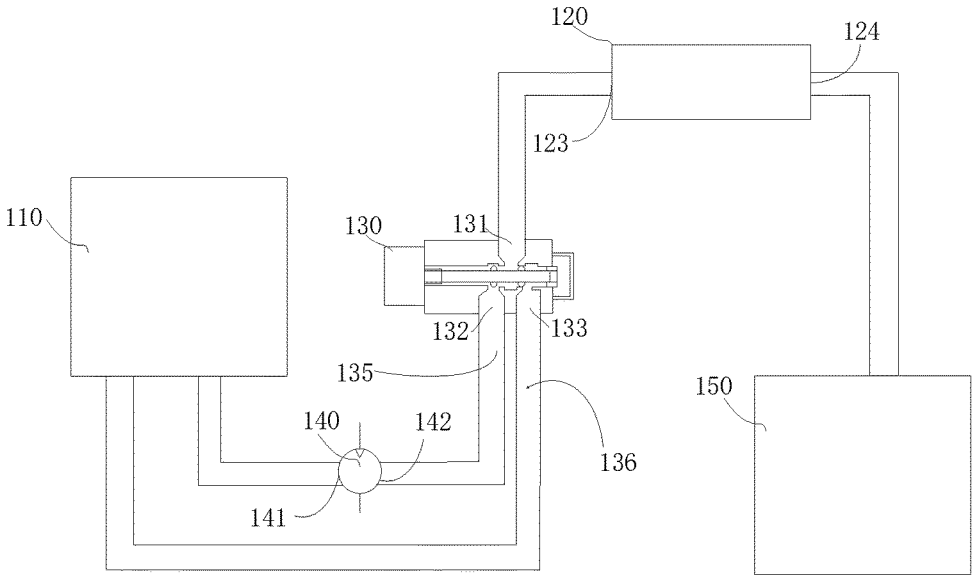
FIG. 1 is a schematic structural view of a refrigerator according to some embodiments of the present disclosure.

As shown in FIG. 1, a refrigerator 100 includes a first fresh-preservation chamber 110, an adsorption tower 120, a valve 130, and an air pump 140. An air inlet 141 of the air pump 140 is in communication with the first fresh-preservation chamber 110, an air outlet 142 of the air pump 140 is in communication with an air inlet 123 of the adsorption tower 120 through an air inlet channel 135 of the valve 130, and the air inlet 123 of the adsorption tower 120 is in communication with the first fresh-preservation chamber 110 through an air outlet channel 136 of the valve 130. When the air inlet channel 135 of the valve 130 is opened, the air pump 140 is configured to pressurize air in the first fresh-preservation chamber 110, and further transmit the air to the adsorption tower 120. In this case, the adsorption tower 120 may be configured to filter out oxygen in the air, the oxygen is discharged from an air outlet 124 of the adsorption tower 120, and residual gas is adsorbed by the adsorption tower 120. When the air inlet channel 135 of the valve 130 is closed, the air pump 140 is configured to stop pressurizing the air and transmitting the air to the adsorption tower 120. In this case, the residual gas is released by the adsorption tower 120, and residual gas discharged into the first fresh-preservation chamber 110 through the air inlet 123 of the adsorption tower 120 and the air outlet channel 136 of the valve 130.

In a fresh-preservation process of the refrigerator 100 according to some embodiments of the present disclosure, the air in the first fresh-preservation chamber 110 is extracted and the oxygen is filtered out, and the residual gas from which the oxygen is removed is returned to the first fresh-preservation chamber 110. In this way, an oxygen content of the first fresh-preservation chamber 110 may be reduced, such that a fresh preservation may be achieved by means of controlling the oxygen. Furthermore, a total air content of the first fresh-preservation chamber 110 may also be reduced, such that the air in the first fresh-preservation chamber 110 may be in a negative pressure state, thereby achieving the fresh preservation by means of the negative pressure. Thus, double fresh-preservation effect may be achieved by means of controlling the oxygen and the negative pressure.

In some embodiments, the valve 130 includes the air inlet channel 135 and the air outlet channel 136, and the air inlet channel 135 and the air outlet channel 136 are arranged separately, thus the valve 130 includes at least three ports. As shown in FIG. 1, the at least three ports include a first port 131, a second port 132, and a third port 133. The first port 131 of the valve 130 is in communication with the air inlet 123 of the adsorption tower 120. The second port 132 of the valve 130 is in communication with the air outlet 142 of the air pump 140. The air inlet channel 135 is defined between the first port 131 and the second port 132 of the valve 130, such that the air outlet 142 of the air pump 140 is in communication with the air inlet 123 of the adsorption tower 120 through the air inlet channel 135 of the valve 130. In addition, the third port 133 of the valve 130 is in communication with the first fresh-preservation chamber 110. The air outlet channel 136 is defined between the third port 133 of the valve 130 and the first port 131 of the valve 130, such that the air inlet 123 of the adsorption tower 120 is in communication with the first fresh-preservation chamber 110 through the air outlet channel 136 of the valve 130. In this case, an air flow direction may be switched via the valve 130.

Figure 2:
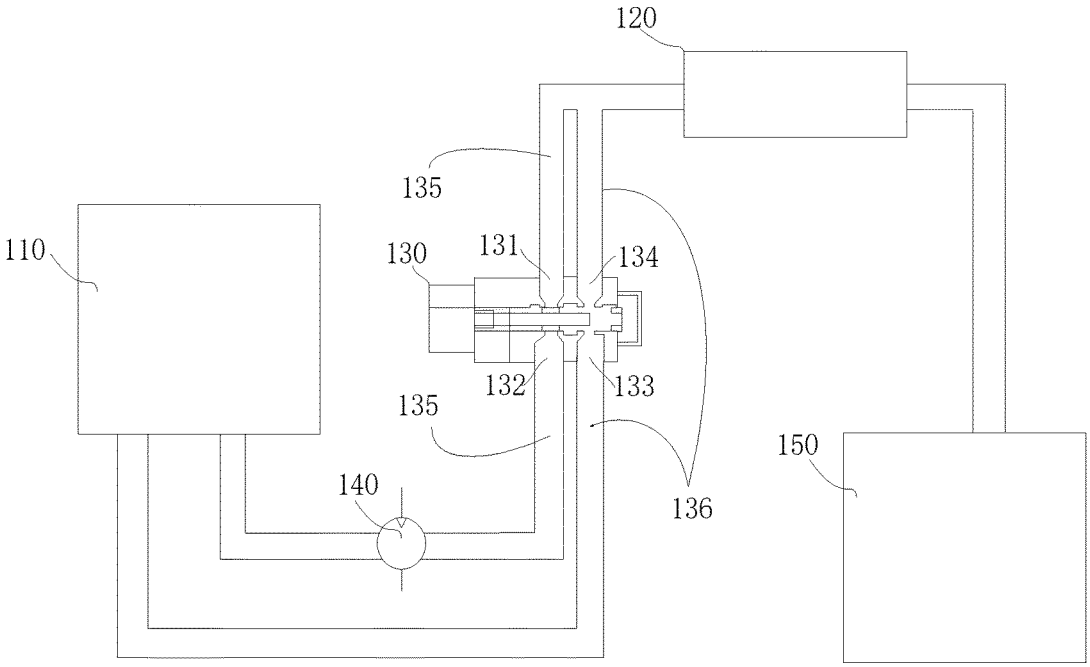
FIG. 2 is a schematic structural view of the refrigerator according to other embodiments of the present disclosure.

In another embodiment, as shown in FIG. 2, the valve 130 may include four ports, and the four ports may be the first port 131, the second port 132, the third port 133, and a fourth port 134. The air inlet 123 of the adsorption tower 120 is in communication with the first port 131 and the fourth port 134. The second port 132 of the valve 130 is in communication with the air outlet 142 of the air pump 140. The air inlet channel 135 is defined between the first port 131 of the valve 130 and the second port 132 of the valve 130. The third port 133 of the valve 130 is in communication with the first fresh-preservation chamber 110. The air outlet channel 136 is defined between the fourth port 134 of the valve 130 and the third port 133 of the valve 130. In this way, the air flow direction may be switched only by switching open/close states of the air inlet channel 135 and the air outlet channel 136 of the valve 130, thereby controlling an inflow and outflow of the air in the first fresh-preservation chamber 110.

The number of the adsorption towers 120 is at least two. Oxygen in the air in the first fresh-preservation chamber 110 may be continuously discharged by at least two adsorption towers 120, and the residual gas adsorbed by the adsorption tower 120 may be continuously desorbed to the first fresh-preservation chamber 110, thus, the oxygen content of the first fresh-preservation chamber 110 may be controlled at a high efficiency and low time-consumption. In some embodiments, the at least two adsorption towers 120 may include a first adsorption tower 121 and a second adsorption tower 122.

Accordingly, the valve 130 defines a first air inlet channel 1351 and a first air outlet channel 1361 corresponding to each first adsorption tower 121. The valve 130 further defines a second air inlet channel 1352 and a second air outlet channel 1362 corresponding to each second adsorption tower 121. By alternately controlling the first air inlet channel 1351 to be opened while the second air inlet channel 1352 of the valve 130 to be closed, or the first air inlet channel 1351 to be closed while the second air inlet channel 1352 to be opened, when one of the first adsorption tower 121 and the second adsorption tower 122 is adsorbing, the residual gas desorbed from the other of the first adsorption tower 121 and the second adsorption tower 122 flows into the first fresh-preservation chamber 110 through the air outlet channel 136, thus the oxygen content of the first fresh-preservation chamber 110 may be controlled at the high efficiency and low time-consumption.

At least two first ports 131 of the valve 130 and at least two third ports 133 of the valve 130 may also be provided. The number of the first ports 131 of the valve 130 and the number of the third ports 133 of the valve 130 may be substantially equal to that of the adsorption towers 120. The air inlet 123 of each adsorption tower 120 may be connected to one of the third ports 133. The air outlet channel 136 is defined between each first port 131 and a corresponding one of the third ports 133. All of the third ports 133 are in communication with the first fresh-preservation chamber 110. In addition, the number of the second ports 132 of the valve 130 may be one, and the air inlet channel 135 may be defined between each first port 131 and the second port 132.

Figure 3:
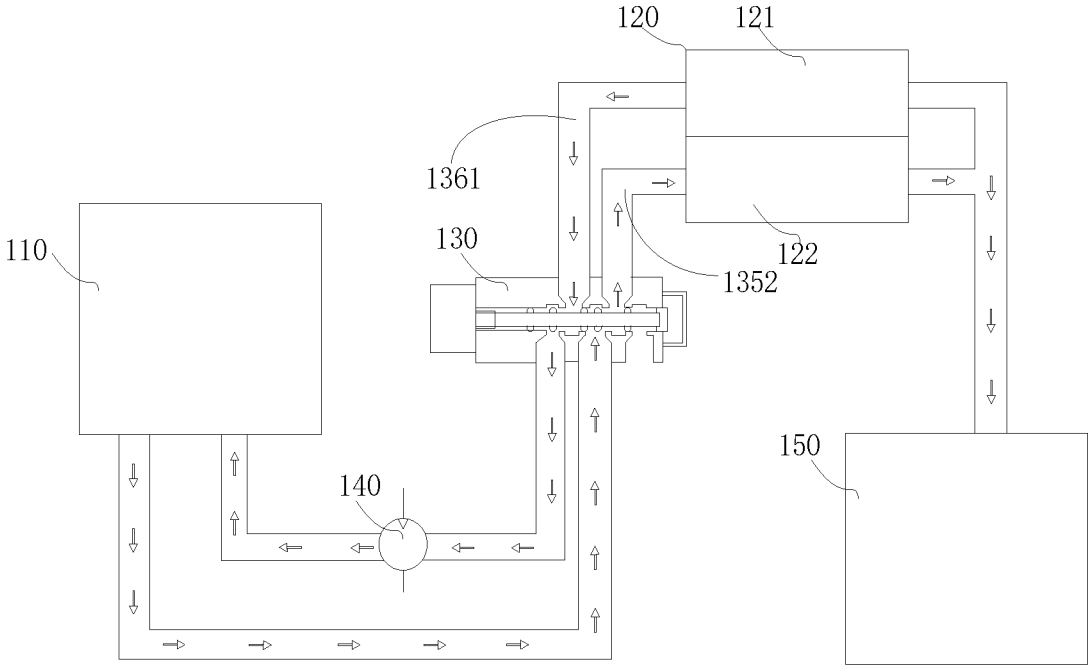
FIG. 3 is a schematic structural view of a working state of the refrigerator according to still other embodiments of the present disclosure.
Figure 4:
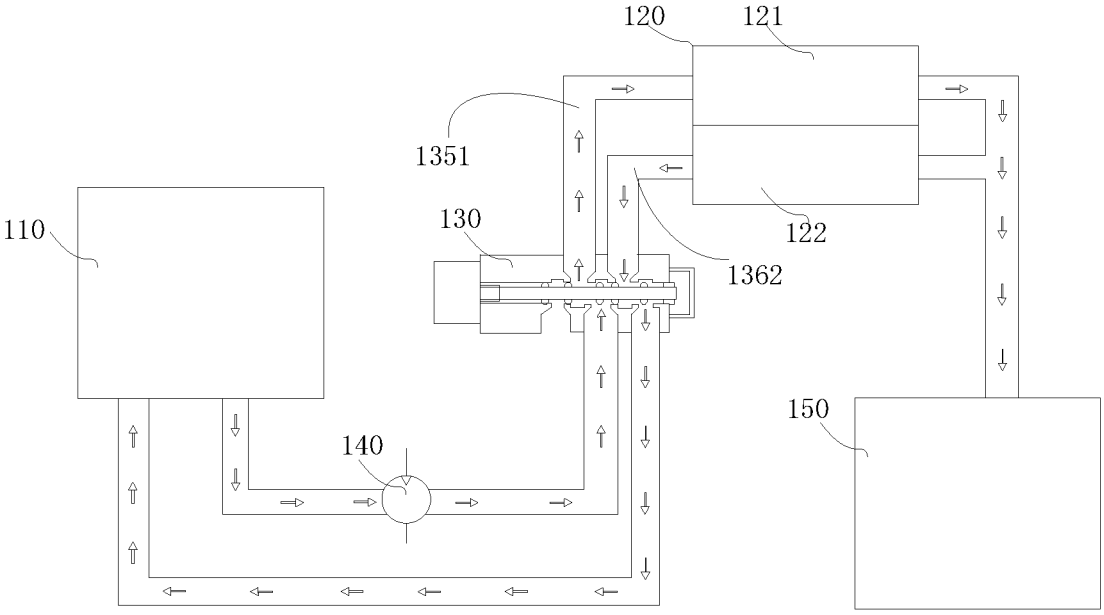
FIG. 4 is a schematic structural view of another working state of the refrigerator according to still other embodiments of the present disclosure.

In another embodiment, as shown in FIG. 3 and FIG. 4, the number of the adsorption towers 120 may be two. The valve 130 may be a two-position five-way solenoid valve. In this way, it is easy to switch opened/closed states of the first air outlet channel 1361, the second air outlet channel 1362, the first air inlet channel 1351, and the second air inlet channel 1362 of the valve 30 by the two-position five-way solenoid valve, such that working states of the two adsorption towers 120 may be switched. In this case, when the one of the first adsorption tower 121 and the second adsorption tower 122 is adsorbing, the residual gas desorbed from the another of the first adsorption tower 121 and the second adsorption tower 122 flows into the first fresh-preservation chamber 110 through the air outlet channel 136. Thus the oxygen in the air in the first fresh-preservation chamber 110 may be continuously discharged by means of controlling an operation of the valve 130 and the air pump 140. The residual gas adsorbed by the adsorption tower 120 may be continuously desorbed and transmitted to the first fresh-preservation chamber 110, thereby controlling the oxygen content of the first fresh-preservation chamber 110 at the high efficiency and low time-consumption.

Figure 5:
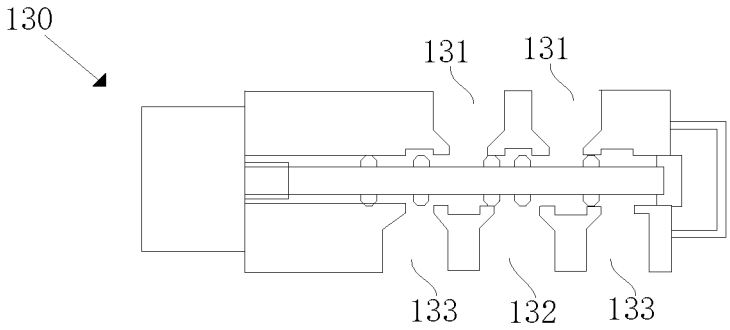
FIG. 5 is a schematic structural view of a valve of the refrigerator according to other embodiments of the present disclosure.

As shown in FIG. 5, the two-position five-way solenoid valve may include two first ports 131, one second port 132, and two third ports 133. One of the two first ports 131 is in communication with an air inlet of the first adsorption tower 121, and the other of the two first ports 131 is in communication with an air inlet of the second adsorption tower 122. The first air outlet channel 1361 is defined between the first port 131 connected to the air inlet of the first adsorption tower 121 and the corresponding third port 133 which is corresponding to the first port 131 connected to the air inlet of the first adsorption tower 121. The second air outlet channel 1362 is defined between the first port 131 connected to the air inlet of the second adsorption tower 122 and the corresponding third port 133 which is corresponding to the first port 131 connected to the air inlet of the second adsorption tower 122. All of the third ports 133 are in communication with the first fresh-preservation chamber 110. The first air inlet channel 1351 is defined between the first port 131 connected to the air inlet of the first adsorption tower 121 and the second port 132. The second air inlet channel 1352 is defined between the first port 131 connected to the air inlet of the second adsorption tower 122 and the second port 132.

In the embodiment, the adsorption tower 120 may be arranged with an adsorbing substance. When the adsorbing substance arranged in the adsorption tower 120 is in an adsorption state, the adsorbing substance has an adsorption capacity in adsorbing nitrogen greater than that of the oxygen. The adsorbing substance arranged in the adsorption tower 120 may be a zeolite molecular sieve particle. A polarity of the nitrogen in the air is greater than that of the oxygen. The zeolite molecular sieve has different adsorption capacities for the oxygen and nitrogen components in the air, such that the nitrogen may be preferentially adsorbed from the air by the zeolite molecular sieve, and the oxygen in the air may be filtered out. Therefore, the air entering from the air inlet 123 of the adsorption tower 120, adsorbed by the zeolite molecular sieve and further flowing out of the adsorption tower 120 may have the oxygen content greater than an oxygen content of the air before entering into the adsorption tower 120, while the gas desorbed from the zeolite molecular sieve has the oxygen content obviously less than the oxygen content of the air before entering into the adsorption tower 120. In other words, the gas desorbed from the zeolite molecular sieve is gas having a low oxygen content. The air desorbed from the zeolite molecular sieve may be further transmitted to the first fresh-preservation chamber 110, thereby reducing the oxygen content of the first fresh-preservation chamber 110, thus the fresh-preservation effect may be achieved. A particle size of the zeolite molecular sieve may be in a range from 0.4 mm to 0.8 mm, such as 0.5 mm, 0.6 mm, or 0.7 mm. Of course, in other embodiments, the adsorbing substance arranged in the adsorption tower 120 may be a phosphate aluminum molecular sieve.

In some embodiments of the present disclosure, the oxygen content of the first fresh-preservation chamber 110 may be controlled by means of an adsorption and desorption of the adsorption tower 120. Since the adsorbing substance has a characteristic that the adsorption capacity increases as a partial pressure of the adsorbed component increases, the adsorption and desorption may be achieved by means of a pressure change, thereby separating the air, that is, the adsorption tower 120 may be in the adsorption state or the desorption state by changing the pressure. In some embodiments, the pressure of the air is increased by the air pump 140, such that the air becomes compressed air, and the compressed air is in turn transmitted into the adsorption tower 120, thereby increasing the pressure in the adsorption tower 120 in a disguised manner. Therefore, the adsorption tower 120 may be in an adsorption stage, that is, at least a part of the oxygen in the compressed air is filtered out by the adsorption tower 120. When the compressed air is no longer transmitted to the adsorption tower 120 by the air pump 140, the pressure in the adsorption tower 120 decreases, and the adsorption capacity of the adsorption tower 120 in adsorbing the nitrogen and other substances is reduced, thus the substance adsorbed by the adsorption tower 120 is desorbed from the adsorption tower 120, and flows into the first fresh-preservation chamber 110 through the air inlet 123 of the adsorption tower 120 and the air outlet channel 136 of the valve 130, that is, the residual gas desorbed from the adsorption tower 120 flows into the first fresh-preservation chamber 110, such that the oxygen content of the first fresh-preservation chamber 110 is reduced, thereby achieving the fresh preservation by means of controlling the oxygen. Furthermore, the total air content of the first fresh-preservation chamber 110 may also be reduced, such that the air in the first fresh-preservation chamber 110 may be in the negative pressure state, thereby achieving the fresh preservation by means of the negative pressure. In this way, the double fresh-preservation effect may be achieved by means of controlling the oxygen and the negative pressure. In the embodiment, a pressure pressurized by the air pump on the air is in a range from 0.12 MPa to 0.2 MPa, according to the particle size of the zeolite molecular sieve.

The air pump 140 may be miniaturized according to a corresponding relationship between the particle size of the zeolite molecular sieve and pressurization on the air by the air pump 140, such that a power consumption of the refrigerator 100 and a noise are reduced. If the particle size of the zeolite molecular sieve is too small, a transmission resistance of the air flow is too large. In this case, to increase the pressure appropriately, the particle size of the zeolite molecular sieve filled in the adsorption tower 120 may be uniform and moderate. For example, the particle size of the zeolite molecular sieve is set in a range from 0.4 mm to 0.8 mm, such that the air pump 140 is not required to increase excessive pressure on the air, thus the air pump 140 may be miniaturized, thereby reducing the power consumption of the refrigerator 100 and the noise.

In the embodiment, a shape of the adsorption tower 120 may be substantially cylindrical. Of course, the adsorption tower 120 may also be in other regular shapes, such as cube, cuboid. The adsorption tower 120 may also be in irregular shape.

The adsorption capacity of the adsorption tower 120 may be controlled by means of controlling a size of the adsorption tower 120. The size of the adsorption tower 120 may be controlled in an appropriate range, thus the adsorption capacity of the adsorption tower 120 may not only be ensured, but also a volume of the adsorption tower 120 may be small. In some embodiments, a diameter of the adsorption tower 120 may be in a range from 20 mm to 30 mm. A height of the adsorption tower 120 may be in a range from 150 mm to 300 mm. Optionally, the diameter of the adsorption tower 120 may be 20 mm, 22 mm, 24 mm, 25 mm, or 27 mm. The height of the adsorption tower 120 may be 160 mm, 186 mm, 200 mm, 230 mm, or 250 mm.

A transmission flow of the air pump 140 is designed correspondingly to a small size design of the adsorption tower 120. A contact duration between molecules in the compressed air and the adsorbing substances in the adsorption tower 120 may be changed by changing the transmission flow of the air pump 140, thereby changing an adsorption efficiency of the adsorption tower 120 for the compressed air. If a transmission speed is too fast, the contact duration between the molecules in the compressed air and the adsorbing substance will be too short, which is not conducive to the adsorption of the air, and the adsorption efficiency is reduced. If the transmission speed is too low, the volume of the adsorption tower 120 will increase. Therefore, the transmission flow should be controlled in an appropriate range. In this embodiment, the transmission flow of the air pump 140 is in a range from 5 L/min to 15 L/min, such as 7 L/min, 9 L/min, or 11 L/min. Of course, in order to ensure the adsorption efficiency of the adsorption tower 120, a ratio of the transmission flow of the air pump 140 per second to the volume of the adsorption tower 120 is in a range from 1.2 to 2.2.

The first fresh-preservation chamber 110 may be a sealed space, such that the air in the first fresh-preservation chamber 110 is not in communication with atmosphere. At least a part of the oxygen in the air in the first fresh-preservation chamber 110 may be removed, and the air from which the oxygen is removed is returned to the first fresh-preservation chamber 110 again. In this way, the oxygen content of the first fresh-preservation chamber 110 is reduced, thereby achieving the fresh preservation by means of controlling the oxygen. Furthermore, the total air content of the first fresh-preservation chamber 110 may also be reduced, such that the air in the first fresh-preservation chamber 110 may be in the negative pressure state, thereby achieving the fresh preservation by means of the negative pressure. Thus, the double fresh-preservation effect may be achieved by means of controlling the oxygen and the negative pressure.

The number of the first fresh-preservation chamber 110 may be one or more. The first fresh-preservation chamber 110 may be a fresh-preservation chamber configured to store food, such as vegetables, fruits, etc. The oxygen content of the first fresh-preservation chamber 110 may be controlled to a low level, such that a respiration rate of food stored in the first fresh-preservation chamber 110 may be reduced, and a metabolism of the food may be inhibited, thereby achieving the fresh-preservation effect, and thus deterioration of the food and reproduction of bacteria are inhibited.

Figure 8:
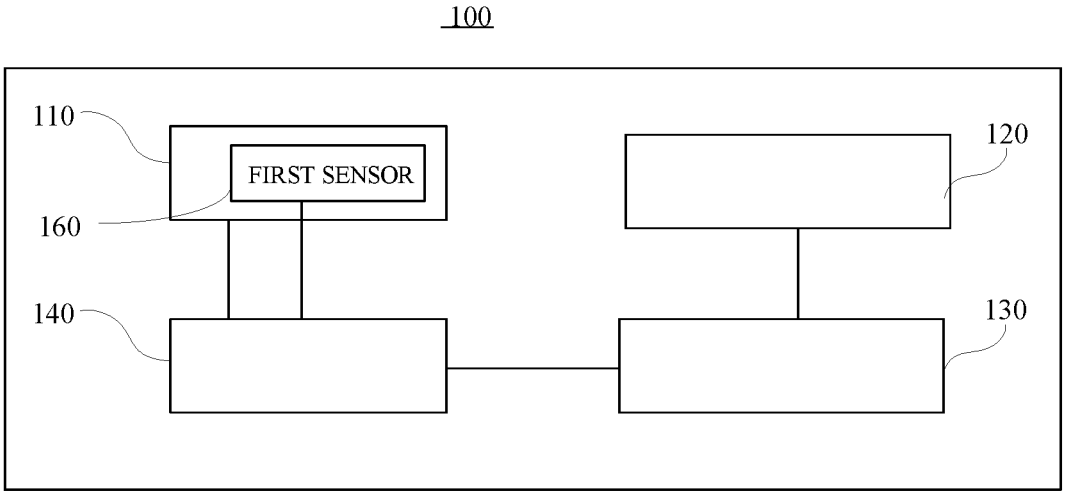
FIG. 8 is a schematic structural view of a refrigerator according to other embodiments of the present disclosure.
Figure 9:
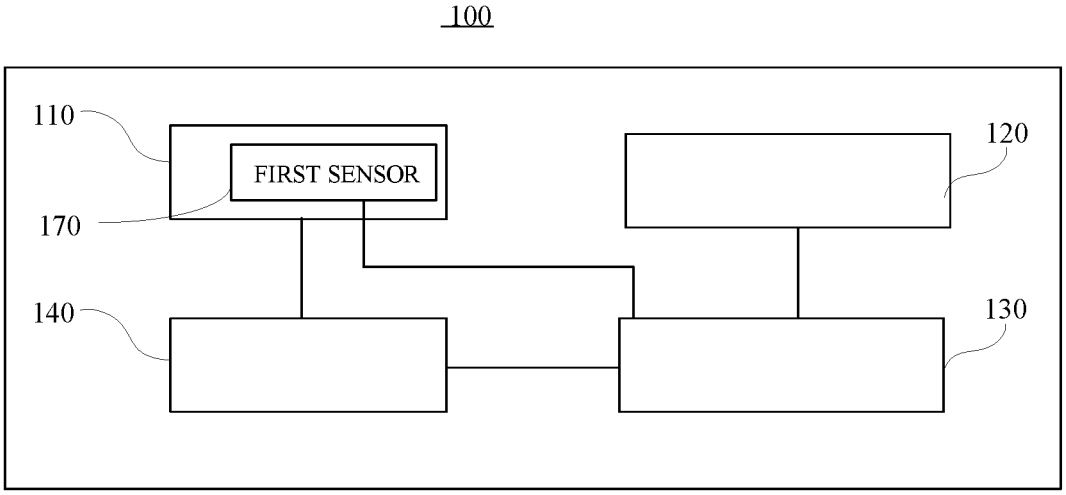
FIG. 9 is a schematic structural view of a refrigerator according to other embodiments of the present disclosure.

As shown in FIG. 8 and FIG. 9, FIG. 8 is a schematic structural view of a refrigerator according to another embodiment of the present disclosure, and FIG. 9 is a schematic structural view of a refrigerator according to another embodiment of the present disclosure. The first fresh-preservation chamber 110 may be arranged with a first sensor 160. The first sensor 160 may be configured to detect the oxygen content of the first fresh-preservation chamber 110. When the oxygen content of the first fresh-preservation chamber 110 detected by the first sensor 160 is greater than a first threshold, the air pump 140 and the valve 130 may be controlled, and the oxygen content of the first fresh-preservation room 110 may be cooperatively controlled by the air pump 140, the valve 130, and the adsorption tower 120, so as to reduce the oxygen content of the first fresh-preservation room 110. When the oxygen content of the first fresh-preservation chamber 110 detected by the first sensor 160 is less than a second threshold, the air pump 140 may be controlled to stop operating, that is, the oxygen content of the first fresh-preservation room 110 is no longer cooperatively controlled by the air pump 140, the valve 130, and the adsorption tower 120. The first sensor 160 is connected to the air pump 140. The first sensor 160 may be further connected to the valve 130.

Figure 10:
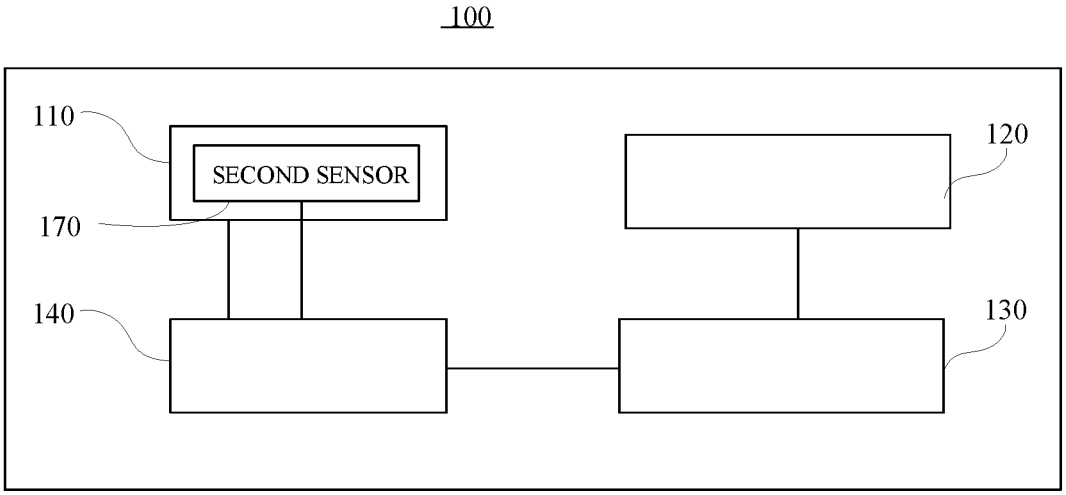
FIG. 10 is a schematic structural view of a refrigerator according to other embodiments of the present disclosure.
Figure 11:
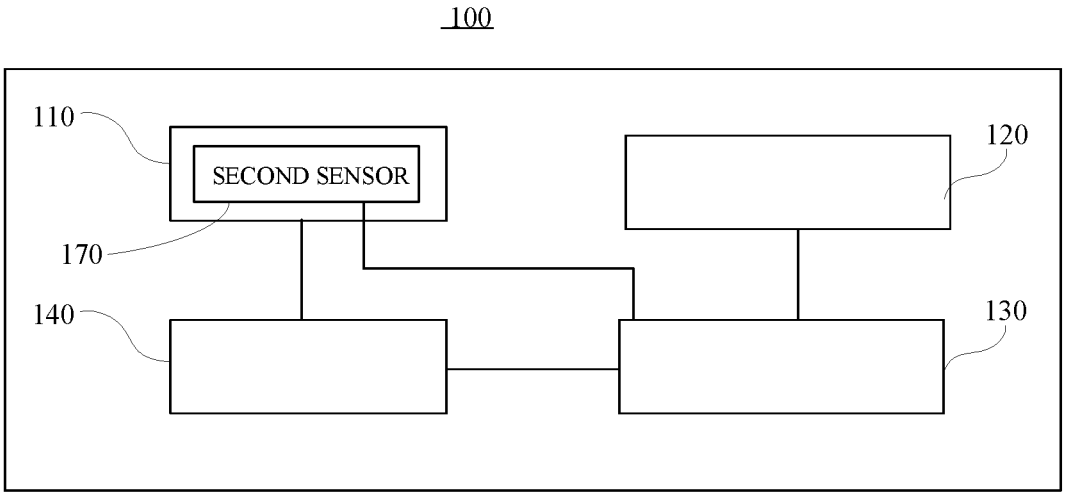
FIG. 11 is a schematic structural view of a refrigerator according to other embodiments of the present disclosure.

As shown in FIG. 10 and FIG. 11, FIG. 10 is a schematic structural view of a refrigerator according to another embodiment of the present disclosure, and FIG. 11 is a schematic structural view of a refrigerator according to another embodiment of the present disclosure. The first fresh-preservation chamber 110 may be further arranged with a second sensor 170. The second sensor 170 is configured to detect whether the first fresh-preservation chamber 110 is opened. When the second sensor 170 detects that the first fresh chamber 110 is opened, the air pump 140 and the valve 130 may be controlled, and the oxygen content of the first fresh-preservation room 110 may be cooperatively controlled by the air pump 140, the valve 130, and the adsorption tower 120, so as to reduce the oxygen content of the first fresh-preservation room 110. The second sensor 170 is connected to the air pump 140. The second sensor 170 may be further connected to the valve 130.

Figure 12:
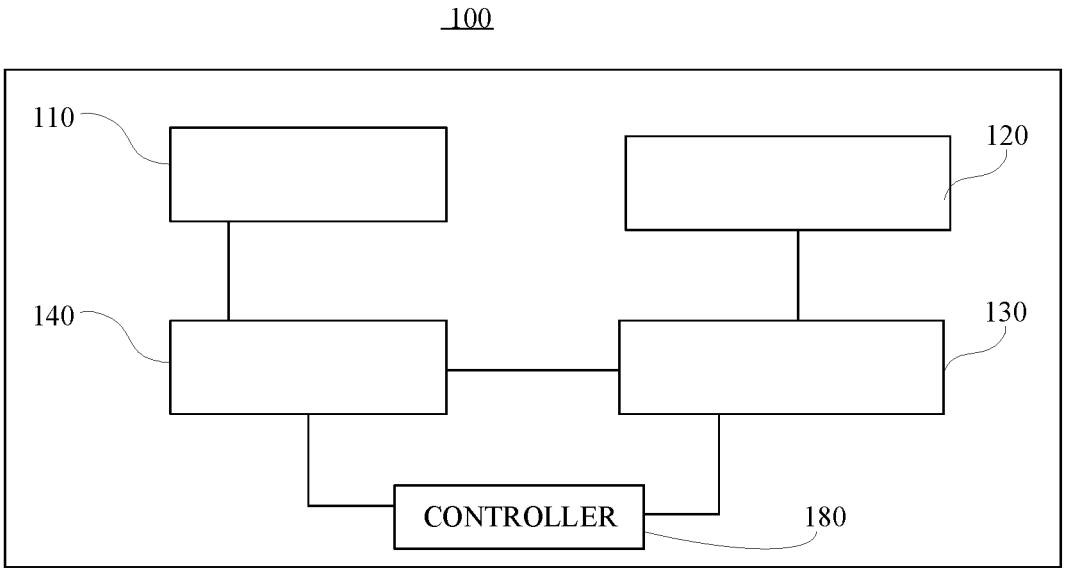
FIG. 12 is a schematic structural view of a refrigerator according to other embodiments of the present disclosure.

As shown in FIG. 12, FIG. 12 is a schematic structural view of a refrigerator according to another embodiment of the present disclosure. In the embodiment, the first fresh-preservation chamber 110 further includes a controller 180. The controller 180 may be connected to the air pump 140 and the valve 130. The controller 180 may be configured to control the operation of the air pump 140. Further, the controller 180 may be configured to control the opened/closed state of the air inlet channel 135 and the air outlet channel 136 of the valve 130.

Furthermore, the controller 180 may also be connected to the first sensor 160, and configured to receive data detected by the first sensor 160. Of course, according to the detected data, the controller 180 may also be configured to analyze whether to control the oxygen content of the first fresh-preservation room 110 by the air pump 140, the valve 130, and the adsorption tower 120. Further, according to an analysis result, the controller 180 may also be configured to control the operations of the air pump 140 and the valve 130.

Furthermore, the controller 180 may also be connected to the second sensor 170, and configured to receive data detected by the second sensor 170. Of course, according to the data detected by the second sensor 170, the controller 180 may be configured to analyze whether to control the oxygen content of the first fresh-preservation room 110 by the air pump 140, the valve 130, and the adsorption tower 120. Further, according to an analysis result, the controller 180 may also be configured to control the operations of the air pump 140 and the valve 130.

In the embodiment, an air outlet switch may also be arranged at the air outlet 124 of the adsorption tower 120. When the adsorption tower 120 is in the adsorption state, the air outlet switch is switched on, such that gas which is not adsorbed by the adsorbing substance in the adsorption tower 120 may be discharged from the air outlet 124 of the adsorption tower 120. When the adsorption tower 120 is in the desorption state, the air outlet switch is switched off, such that air desorbed from the adsorption tower 120 can only flow into the first fresh-preservation chamber 110 through the air inlet 123 of the adsorption tower 120 and the air inlet channel 135 of the valve 130. Besides, it is possible to prevent outside air from entering into the adsorption tower 120 through the air outlet 124 of the adsorption tower 120, such that it is possible to prevent the outside air from flowing into the first fresh-preservation chamber 110 together with the air desorbed from the adsorption tower 120, thereby ensuring an efficiency of reducing the oxygen content of the first fresh-preservation chamber 110.

In the embodiment, the refrigerator 100 further includes a second fresh-preservation chamber 150. The air outlet 124 of the adsorption tower 120 is in communication with the second fresh-preservation chamber 150. In other words, the second fresh-preservation chamber 150 may be configured to receive oxygen-enriched air which is discharged from the adsorption tower 120, such that an oxygen content of the second fresh-preservation chamber 150 is increased. The second fresh-preservation chamber 150 may be configured to store meats. A fresh-preservation color of meats stored in the second fresh-preservation room 150 may be ensured to be bright by means of increasing the oxygen content of the second fresh-preservation room 150.

Figure 6:
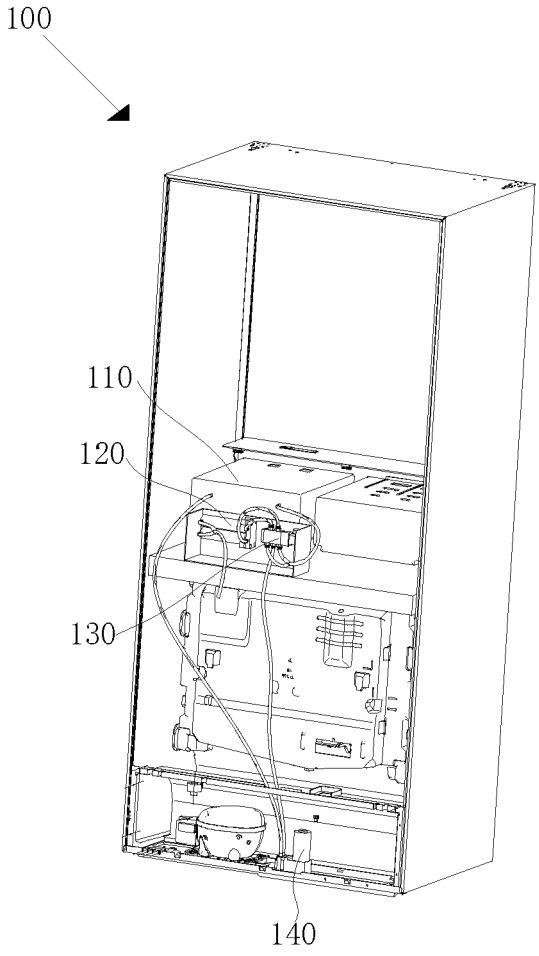
FIG. 6 is a perspective schematic view of the refrigerator according to yet other embodiments of the present disclosure.
Figure 7:
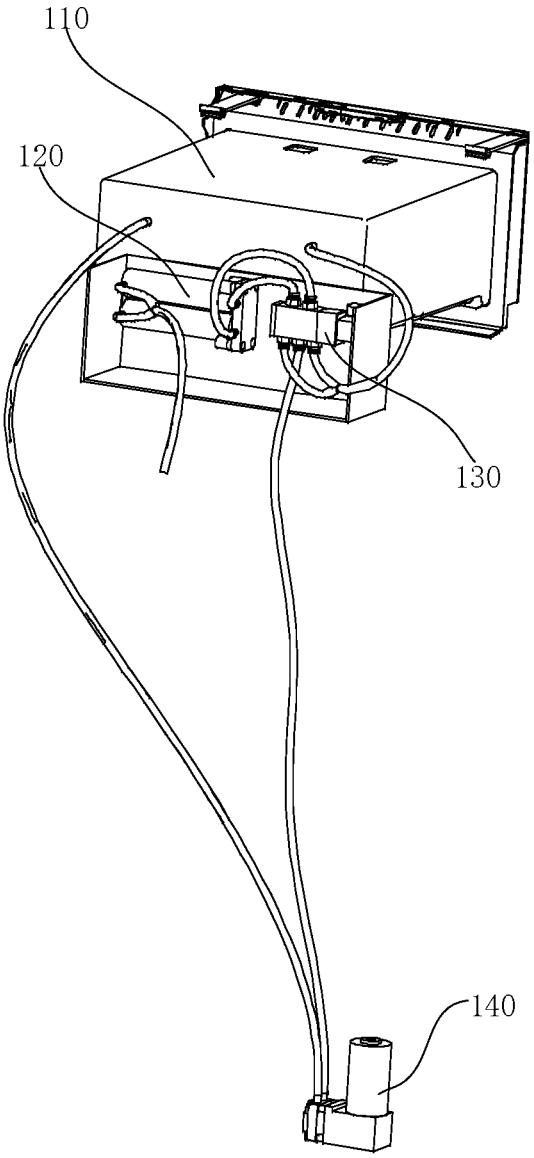
FIG. 7 is a partial structural schematic view of the refrigerator shown in FIG. 6.

As shown in FIG. 6 and FIG. 7, specifically, the first fresh-preservation chamber 110 is disposed in the refrigerator 100 in a manner of a drawer. The adsorption tower 120 and the valve 130 are disposed at a back of the first fresh-preservation chamber 110, that is, the adsorption tower 120 and the valve 130 are disposed at a side of the first fresh-preservation chamber 110 away from the refrigerator 100. In this way, when the first fresh-preservation chamber 110 is opened, an impact on a position of the valve 130 and the adsorption tower 120 may be reduced, and an impact on a connection relationship among the valve 130, the adsorption tower 120, and the air pump 140 may also be reduced. The air pump 140 is disposed at a bottom of the refrigerator 100. The first fresh-preservation chamber 110 is connected to the air inlet 141 of the air pump 140 by an air tube, the air outlet 142 of the air pump 140 is connected to the valve 130 by another air tube, and the adsorption tower 120 is connected to the valve 130 by an additional air tube. In this way, when the first fresh-preservation chamber 110 is opened, connections among the air inlets and the air outlets are not affected. The air tube may be a soft air tube or a rigid air tube.

Furthermore, when the number of the adsorption towers 120 is two, the two adsorption towers 120 are arranged side by side, and all of the air inlets of the adsorption towers 120 are arranged to face the same direction, such that a structure and a layout of the entire refrigerator 100 are compact.

In short, in the fresh-preservation process of the refrigerator, the air in the first fresh-preservation chamber 110 is extracted and the oxygen is filtered out, and the residual gas from which the oxygen is removed is returned to the first fresh-preservation chamber 110. In this way, the oxygen content of the first fresh-preservation chamber 110 may be reduced, such that the fresh preservation may be achieved by means of controlling the oxygen. Furthermore, the total air content of the first fresh-preservation chamber 110 may also be reduced, such that the air in the first fresh-preservation chamber 110 may be in the negative pressure state, thereby achieving the fresh preservation by means of the negative pressure, thus double fresh-preservation effect may be achieved by means of controlling the oxygen and the negative pressure.

According to an aspect of the present disclosure, a refrigerator is provided. The refrigerator includes a first fresh-preservation chamber, one or more adsorption towers, a valve, and an air pump. An air inlet of the air pump is in communication with the first fresh-preservation chamber, an air outlet of the air pump is in communication with an air inlet of each of the one or more adsorption towers through an air inlet channel of the valve, and the air inlet of each of the one or more adsorption towers is in communication with the first fresh-preservation chamber through an air outlet channel of the valve. In response to the air inlet channel of the valve being opened, the air pump is configured to pressurize air in the first fresh-preservation chamber, and transmit the air to each of the one or more adsorption towers, each of the one or more adsorption towers is configured to filter out oxygen in the air, the oxygen is discharged from an air outlet of each of the one or more adsorption towers, and residual gas is adsorbed by each of the one or more adsorption towers. In response to the air inlet channel of the valve being closed, the air pump is configured to stop pressurizing the air and transmitting the air to each of the one or more adsorption towers, the residual gas is released by each of the one or more adsorption towers, and discharged to the first fresh-preservation chamber through the air inlet of each of the one or more adsorption towers and the air outlet channel of the valve.

In some embodiments, the one or more adsorption towers include at least two adsorption towers, and the at least two adsorption towers include a first adsorption tower and a second adsorption tower. the valve defines a first air inlet channel and a first air outlet channel corresponding to each first adsorption tower, and defines a second air inlet channel and a second air outlet channel corresponding to each second adsorption tower. The valve is alternately switched between a state that the first air inlet channel is opened while the first air inlet channel of the valve is closed and a state that the first air inlet channel is closed while the second air inlet channel is opened.

In some embodiments, the one or more adsorption towers include two adsorption towers, and the valve is a two-position five-way solenoid valve.

In some embodiments, the at least two adsorption towers are arranged side by side, and all of the air inlets of the adsorption towers are arranged to face a same direction.

In some embodiments, each of the one or more adsorption towers is arranged with a zeolite molecular sieve particle, and a particle size of the zeolite molecular sieve particle is in a range from 0.4 mm to 0.8 mm. A pressure pressurized by the air pump on the air is in a range from 0.12 MPa to 0.2 MPa.

In some embodiments, a ratio of a transmission flow of the air pump per second to a volume of each of the one or more adsorption towers is in a range from 1.2 to 2.2.

In some embodiments, a shape of each of the one or more adsorption towers is substantially cylindrical, a diameter of each of the one or more adsorption towers is in a range from 20 mm to 30 mm, and a height of each of the one or more adsorption towers is in a range from 150 mm to 300 mm. A transmission flow of the air pump is in a range from 5 L/min to 15 L/min.

In some embodiments, the refrigerator further includes a second fresh-preservation chamber. The air outlet of the air outlet of each of the one or more adsorption towers is in communication with the second fresh-preservation chamber.

In some embodiments, the first fresh-preservation chamber is arranged with a first sensor, and the first sensor is configured to detect the oxygen content of the first fresh-preservation chamber and is connected to the air pump.

In some embodiments, the first fresh-preservation chamber is arranged with a second sensor, and the second sensor is configured to detect whether the first fresh-preservation chamber is opened and is connected to the air pump.

In some embodiments, the refrigerator further includes a controller connected to the air pump and the valve.

In some embodiments, the valve includes a plurality of ports.

In some embodiments, the plurality of ports include a first port, a second port, and a third port, the air inlet channel is defined between the first port and the second port, and the air outlet channel is defined between the third port and the first port.

In some embodiments, the plurality of ports include a first port, a second port, a third port, and a fourth port, the air inlet channel is defined between the first port and the second port, and the air outlet channel is defined between the third port and the fourth port.

In some embodiments, each of the one or more adsorption towers is arranged with a phosphate aluminum molecular sieve.

In some embodiments, each of the one or more adsorption towers and the valve are disposed at a side of the first fresh-preservation chamber away from the refrigerator, and the air pump is disposed at a bottom of the refrigerator.

The above are only embodiments of the present disclosure and are not intended to limit the scope of the present disclosure. Any equivalent structural changes made under the concept of the present disclosure, using the contents of the specification of the present disclosure and the accompanying drawings, or applied directly/indirectly in other related fields of technology are included in the scope of protection of the present disclosure.

What is claimed is:

1. A refrigerator, comprising:

a first fresh-preservation chamber, one or more adsorption towers, a valve, and an air pump;

wherein an air inlet of the air pump is in communication with the first fresh-preservation chamber, an air outlet of the air pump is in communication with an air inlet of each of the one or more adsorption towers through an air inlet channel of the valve, and the air inlet of each of the one or more adsorption towers is in communication with the first fresh-preservation chamber through an air outlet channel of the valve;

in response to the air inlet channel of the valve being opened, the air pump is configured to pressurize air in the first fresh-preservation chamber, and transmit the air to each of the one or more adsorption towers, each of the one or more adsorption towers is configured to filter out oxygen in the air, the oxygen is discharged from an air outlet of each of the one or more adsorption towers, and residual gas is adsorbed by each of the one or more adsorption towers; and in response to the air inlet channel of the valve being closed, the air pump is configured to stop pressurizing the air and transmitting the air to each of the one or more adsorption towers, the residual gas is released by each of the one or more adsorption towers, and discharged to the first fresh-preservation chamber through the air inlet of each of the one or more adsorption towers and the air outlet channel of the valve, wherein the one or more adsorption towers comprise at least two adsorption towers, and the at least two adsorption towers comprise a first adsorption tower and a second adsorption tower;

the valve defines a first air inlet channel and a first air outlet channel corresponding to each first adsorption tower, and defines a second air inlet channel and a second air outlet channel corresponding to each second adsorption tower; and the valve is alternately switched between a state that the first air inlet channel is opened while the second air inlet channel of the valve is closed and a state that the first air inlet channel is closed while the second air inlet channel is opened.

2. The refrigerator as claimed in claim 1, wherein the one or more adsorption towers comprise two adsorption towers, and the valve is a two-position five-way solenoid valve.

3. The refrigerator as claimed in claim 1, wherein the at least two adsorption towers are arranged side by side, and all of the air inlets of the adsorption towers are arranged to face a same direction.

4. The refrigerator as claimed in claim 1, wherein each of the one or more adsorption towers is arranged with a zeolite molecular sieve particle, and a particle size of the zeolite molecular sieve particle is in a range from 0.4 mm to 0.8 mm; and a pressure pressurized by the air pump on the air is in a range from 0.12 I\SPa to 0.2 MPa.

5. The refrigerator as claimed in claim 4, wherein a ratio of a transmission flow of the air pump per second to a volume of each of the one or more adsorption towers is in a range from 1.2 to 2.2.

6. The refrigerator as claimed in claim 5, wherein a shape of each of the one or more adsorption towers is cylindrical, a diameter of each of the one or more adsorption towers is in a range from 20 mm to 30 mm, and a height of each of the one or more adsorption towers is in a range from 150 mm to 300 mm; and a transmission flow of the air pump is in a range from 5 L/min to 15 L/min.

7. The refrigerator as claimed in claim 1, further comprising: a second fresh-preservation chamber;

wherein the air outlet of each of the one or more adsorption towers is in communication with the second fresh-preservation chamber.

8. The refrigerator as claimed in claim 1, wherein the first fresh-preservation chamber is arranged with a first sensor, and the first sensor is configured to detect the oxygen content of the first fresh-preservation chamber and is connected to the air pump.

9. The refrigerator as claimed in claim 1, wherein the first fresh-preservation chamber is arranged with a second sensor, and the second sensor is configured to detect whether the first fresh-preservation chamber is opened and is connected to the air pump.

10. The refrigerator as claimed in claim 1, further comprising:

a controller connected to the air pump and the valve.

11. The refrigerator as claimed in claim 1, wherein the valve comprises a plurality of ports.

12. The refrigerator as claimed in claim 11, wherein the plurality of ports comprise a first port, a second port, and a third port, the air inlet channel is defined between the first port and the second port, and the air outlet channel is defined between the third port and the first port.

13. The refrigerator as claimed in claim 11, wherein the plurality of ports comprise a first port, a second port, a third port, and a fourth port, the air inlet channel is defined between the first port and the second port, and the air outlet channel is defined between the third port and the fourth port.

14. The refrigerator as claimed in claim 1, wherein each of the one or more adsorption towers is arranged with a phosphate aluminum molecular sieve.

15. The refrigerator as claimed in claim 1, wherein each of the one or more adsorption towers and the valve are disposed at a side of the first fresh-preservation chamber away from the refrigerator, and the air pump is disposed at a bottom of the refrigerator.

* * * * *